US007083061B2

(12) United States Patent
Spindel et al.

(10) Patent No.: US 7,083,061 B2
(45) Date of Patent: Aug. 1, 2006

(54) COLLAPSIBLE BOX WITH TOP ACCESS, SIDE ACCESS AND INTERCONNECTED VERTICAL STACKING

(76) Inventors: Martin Spindel, 501 7th Ave. -18th Floor, New York, NY (US) 10018; Nadine Cino, 501 7th Ave. -18th Floor, New York, NY (US) 10018

( * ) Notice: Subject to any disclaimer, the term of this patent is extended or adjusted under 35 U.S.C. 154(b) by 8 days.

(21) Appl. No.: 10/245,643

(22) Filed: Sep. 16, 2002

(65) Prior Publication Data

US 2003/0052158 A1 Mar. 20, 2003

Related U.S. Application Data

(60) Provisional application No. 60/327,116, filed on Oct. 4, 2001, provisional application No. 60/323,045, filed on Sep. 17, 2001.

(51) Int. Cl.
*B65D 6/18* (2006.01)
*B65D 88/52* (2006.01)

(52) U.S. Cl. ..... 220/6; 217/15; 217/47; 217/59; 220/1.5

(58) Field of Classification Search ..... 220/1.5, 220/4.28, 6, 7; 206/509; 217/15, 47, 59
See application file for complete search history.

(56) References Cited

U.S. PATENT DOCUMENTS 1,091,391 A * 3/1914 Romans ..... 217/15
3,363,800 A * 1/1968 Anderson ..... 220/4.01
3,796,342 A 3/1974 Sanders et al.
4,577,772 A 3/1986 Bigliardi
4,630,746 A 12/1986 Fortenberry
4,646,928 A * 3/1987 Ono et al. ..... 220/6
4,679,242 A * 7/1987 Brockhaus ..... 383/4
4,693,387 A 9/1987 Stonier
5,038,953 A 8/1991 Radar
5,064,068 A 11/1991 Sheng
5,107,639 A 4/1992 Morin et al.
5,671,858 A 9/1997 Hsu (Continued)

*Primary Examiner*—Nathan J. Newhouse
*Assistant Examiner*—Niki M. Eloshway
(74) *Attorney, Agent, or Firm*—Levisohn, Berger & Langsam LLP

(57) ABSTRACT

A collapsible box that provides access through both its top and front side. When set up, said box comprises a (i) horizontal upper section and (ii) horizontal lower section, said sections attached to each other via a pair of opposed vertical sidewalls. When said upper section is gripped by hand and lifted upwardly, said upper section will separate from said lower section and the box will open. Each of said sidewalls comprises a set of upper and lower panels, said panels attached to each other via a hinge that extends horizontally across the approximate center of said sidewall. The top of each sidewall is attached to one end of said upper section via a horizontal hinge; the bottom of each sidewall is attached to one end of said lower section via a horizontal hinge. Said lower section comprises the floor of said box. Said upper section comprises the top lid and two panels that rest horizontally underneath said top lid. As said box is being set up, said panels resting underneath said top lid can be moved into position to form the (i) back wall and (ii) front door. In a preferred embodiment, a set of track and runner structures provide a means of connecting a plurality of vertically stacked boxes, all of said connected boxes opening simultaneously when the top box is lifted upward.

16 Claims, 21 Drawing Sheets

U.S. PATENT DOCUMENTS 6,036,041 A * 3/2000 Chern ..... 220/6

6,223,400 B1 * 5/2001 Lenack ..... 229/125.39

* cited by examiner

COLLAPSIBLE BOX WITH TOP ACCESS, SIDE ACCESS AND INTERCONNECTED VERTICAL STACKING

CROSS REFERENCE TO RELATED APPLICATIONS

This application claims priority to U.S. Provisional Patent Application Ser. Nos. 60/323,045 and 60/327,116 filed Sep. 17, 2001 and Oct. 4, 2001, respectively.

BACKGROUND OF THE INVENTION

Boxes are commonly used in transporting, moving, conveying, sorting and storing goods and materials, and are employed by a diversity of industries such as trucking, warehousing, manufacturing, office moving and household goods moving.

The box of the present invention is collapsible. As such, it can be quickly and easily collapsed for compact storage and, just as quickly and easily, set up for use.

A major benefit of the box of the present invention is that, when set up, both the top lid and front door of said box can be opened at the same time. Thereby, objects can be loaded into said box (or unloaded from it) without either lifting them over a front wall or sliding them under a top wall. Such configuration in which both the top lid and front door are simultaneously open is possible when said box is either standing alone or positioned at the top of a stack of other boxes.

When the box of the present invention has other boxes stacked above it, the front wall of said box can still be opened. Thus, another major benefit of the present invention is that frontal access to any box in a stack is possible. Thereby, objects can be loaded into, or unloaded from, a lower box within a stack without lifting the box or boxes above it. Since both the top wall and front wall of the box of the present invention can be opened, said walls are referred to herein as a "top lid" and "front door," respectively. The bottom wall of said box is referred to as the "floor." Said box may be made of plastic, wood, metal or cardboard.

U.S. Pat. Nos. 3,796,342 to Sanders et. al. and 4,693,387 to Stonier disclose collapsible containers. However, the Sanders and Stonier containers only allow top access. Neither container allows front access, as does the box of the present invention. Nor do the Sanders and Stonier containers disclose either (i) a combination of both front and top access or (ii) any form of a front lid or door, as does the present invention. The benefits of the present invention over Sanders and Stonier are significant in that the present invention allows (i) frontal access to any box in a stack without removing the boxes above it and (ii) easy loading and unloading with lifting objects over a sidewall or sliding objects under a top lid. Furthermore, the structure of the present invention comprises a pair of vertical inner sidewalls (items 301 in FIGS. 4A and 4B) that provide additional strength for bearing a load; the Sanders and Stonier containers lack such inner sidewalls.

SUMMARY OF THE INVENTION

In a preferred embodiment, the box of the present invention comprises a (i) horizontal lower section and (ii) horizontal upper section. Said lower section is primarily comprised of a single flat surface that forms the floor of said box.

When the box of the present invention is closed (in collapsed position), said upper section is primarily comprised of three horizontal panels which rest one atop another. The uppermost panel forms the top lid of said box. When said box is in the process of being opened, the lowermost panel swings downward to form the back wall of said box. After said box has been opened, the middle panel can be pulled into position to form the front door of said box. In an alternative embodiment, the panel that forms said front door could rest above said top lid.

When the box of the present invention is open (in set-up position), said horizontal upper section (essentially the top lid) and horizontal lower section (essentially the floor) are connected to each other via a pair of opposed vertical sidewalls, referred to herein as "outer sidewalls." Each outer sidewall is primarily comprised of a set of upper and lower panels that are attached to each other via a hinge that extends horizontally across the center (or near center) of said sidewall. Accordingly, each outer sidewall is capable of more or less folding in half along said hinge.

The top of each outer sidewall is attached to said horizontal upper section (essentially the top lid) via another horizontal hinge; the bottom of each outer sidewall is attached to said horizontal lower section (essentially the floor) via yet another horizontal hinge. Such configuration of hinged panels and walls allows the box to be quickly and easily opened (set-up) and closed (collapsed).

When the box of the present invention is open, said box also comprises a pair of opposed vertical inner sidewalls. Each inner sidewall is primarily comprised of a single solid panel, as opposed to the outer sidewalls which are comprised of hinged upper and lower panels. Said solid panels of the inner sidewalls provide strength, and prevent the outer sidewalls from folding, when the box of the present invention is supporting a load on its top lid. Each of said inner sidewalls stands adjacent to, and on the interior side of, a respective outer sidewall.

BRIEF DESCRIPTION OF THE DRAWINGS

FIG. 10*c* is illustrated as if inner sidewall panels 301 were in the position shown in FIG. 3B.

DETAILED DESCRIPTION OF THE INVENTION

Figure 1:
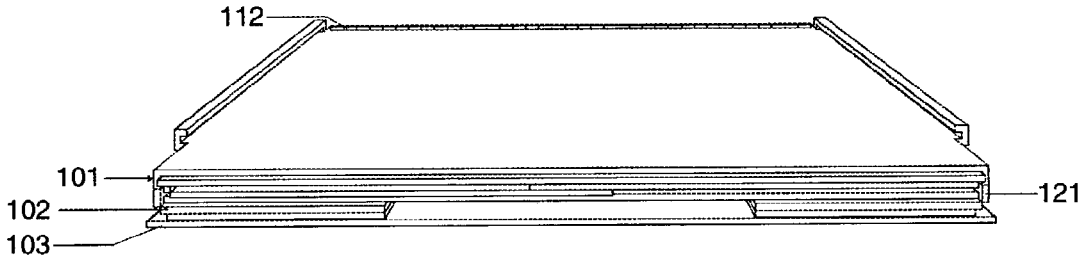
FIGS. 1 through 6 are perspective views showing the successive stages in which the box of the present invention progresses from closed to open position.

FIG. 1 is a view of the box of the present invention in a collapsed or closed position. Said box comprises two main sections: (i) upper section 101 and (ii) lower section 103. Said upper and lower sections are connected by outer sidewalls 102. When upper section 101 is gripped by hand and lifted upwardly, said upper section will separate from lower section 103 and the box will open. Lower section 103 comprises the floor of said box.

Figure 2:
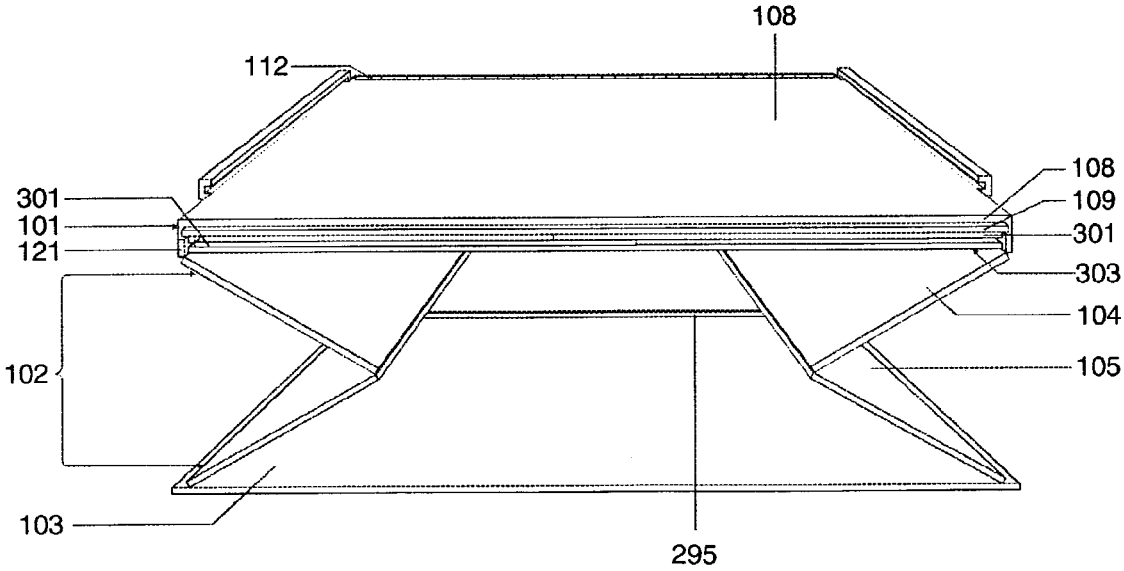
Figure 8A:
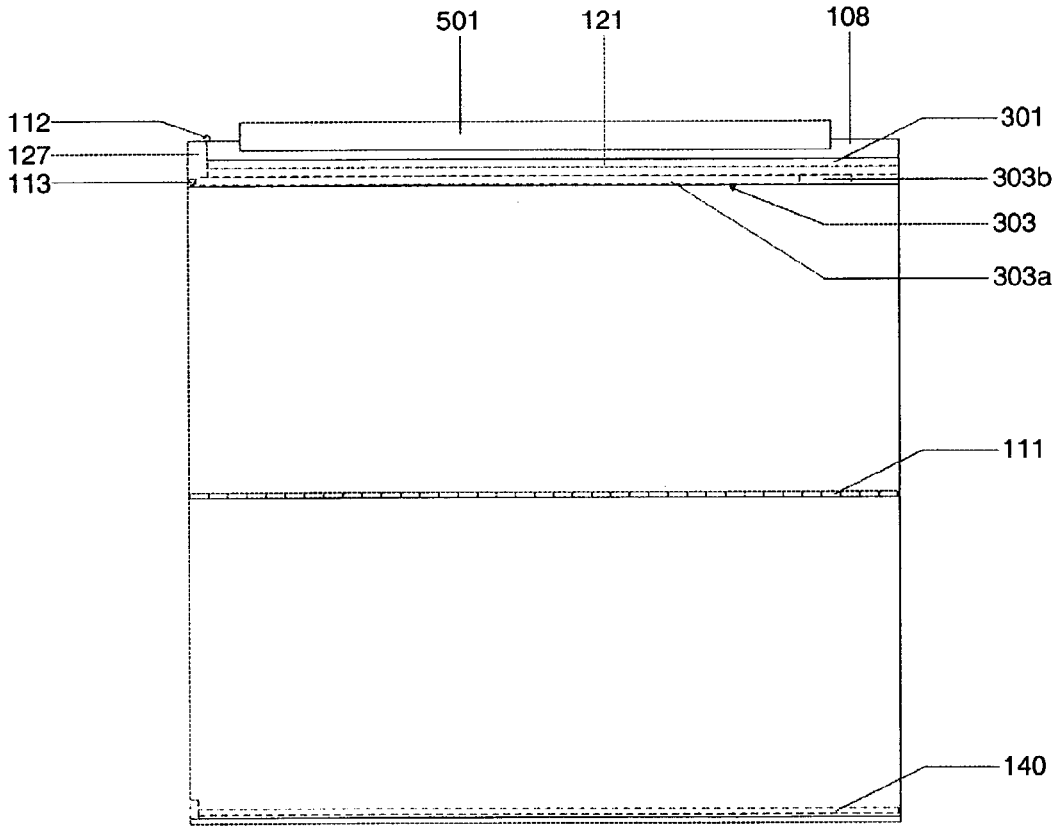
FIGS. 8A thru 8C are side views showing the lowermost panel of the upper section (illustrated with broken lines) during successive stages of swinging downward to form the back wall.

As the box of the present invention opens, it successively moves through the positions shown in FIGS. 1, 2, 3A, 3B, 4A and 4B. FIG. 2 shows outer sidewalls 102 about halfway open. Each of said outer sidewalls 102 is comprised of upper and lower panels 104 and 105, respectively. As shown in FIG. 2, outer sidewall panels 104 and 105 are folded inward. As the box opens, said panels rotate outwardly on hinge 111 (FIG. 8A). Also, as the box opens, back wall panel 303 (FIG. 3A) will rotate into open position on a hinge.

Figure 3A:
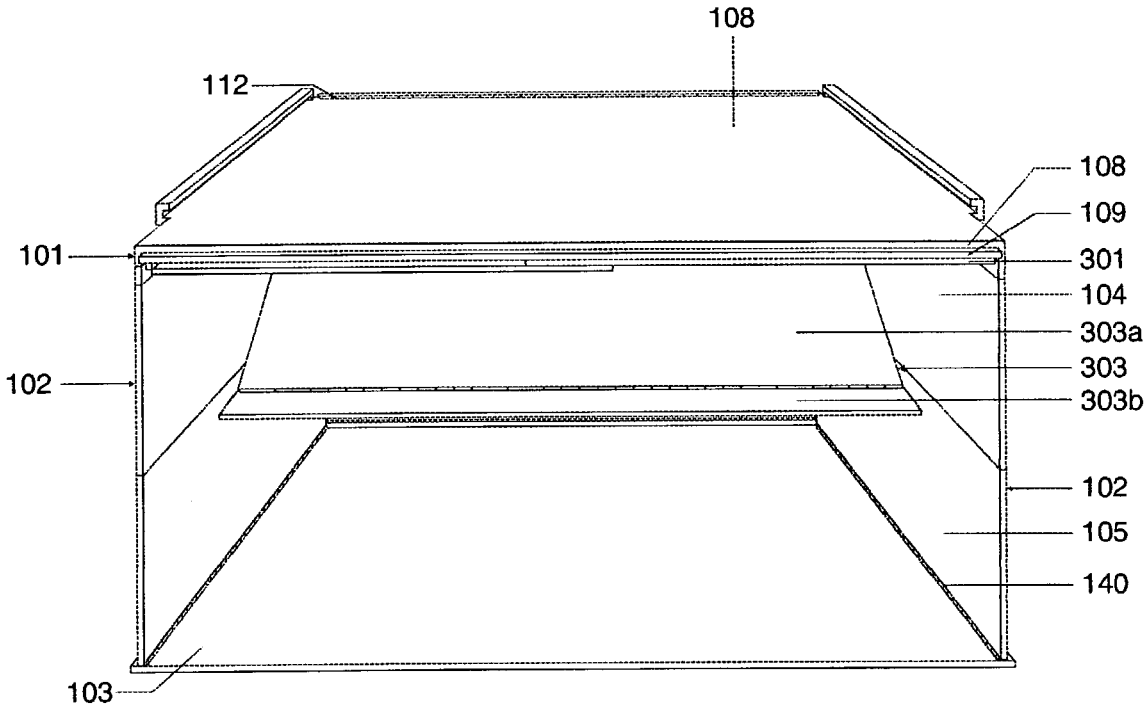
Figure 3B:
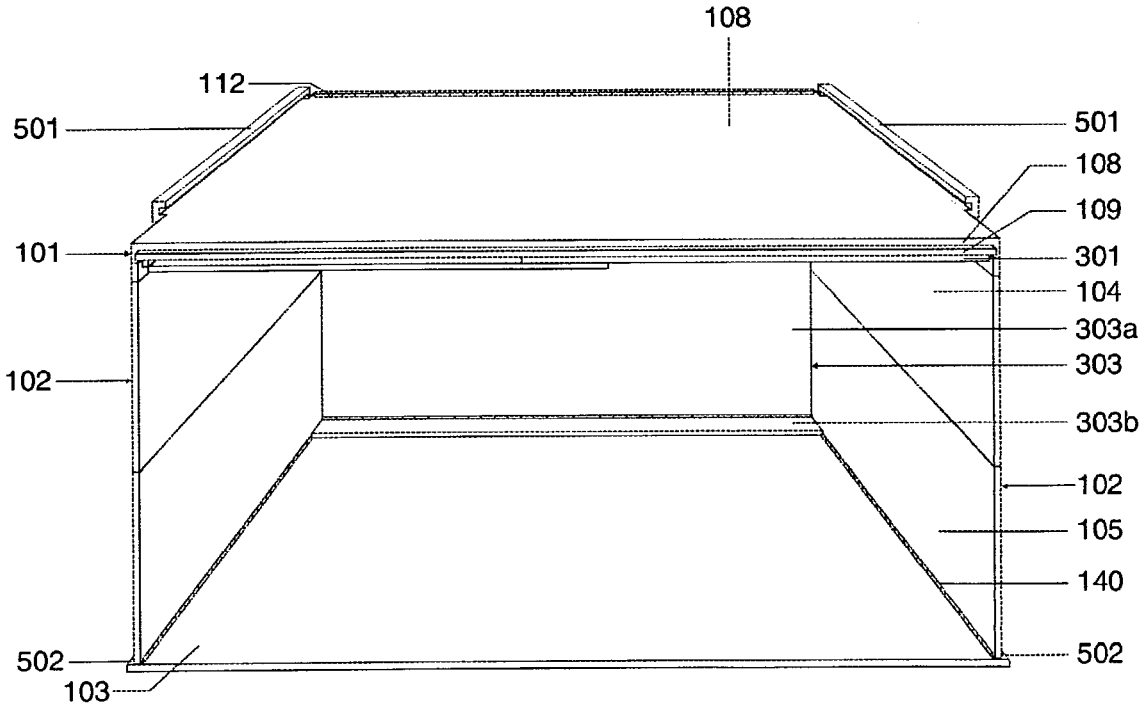

As outer sidewalls 102 move into open position, panel 303 rotates downward to form the back wall of the box of the present invention. FIGS. 3A and 3B show outer sidewalls 102 fully open, thereby forming the left and right sidewalls of the box. FIG. 3A shows panel 303 at the point where said panel has rotated about halfway downward. FIG. 3B shows panel 303 at the point where said panel has rotated downward ninety degrees, thereby forming the back wall of the box of the present invention.

Figure 8B:
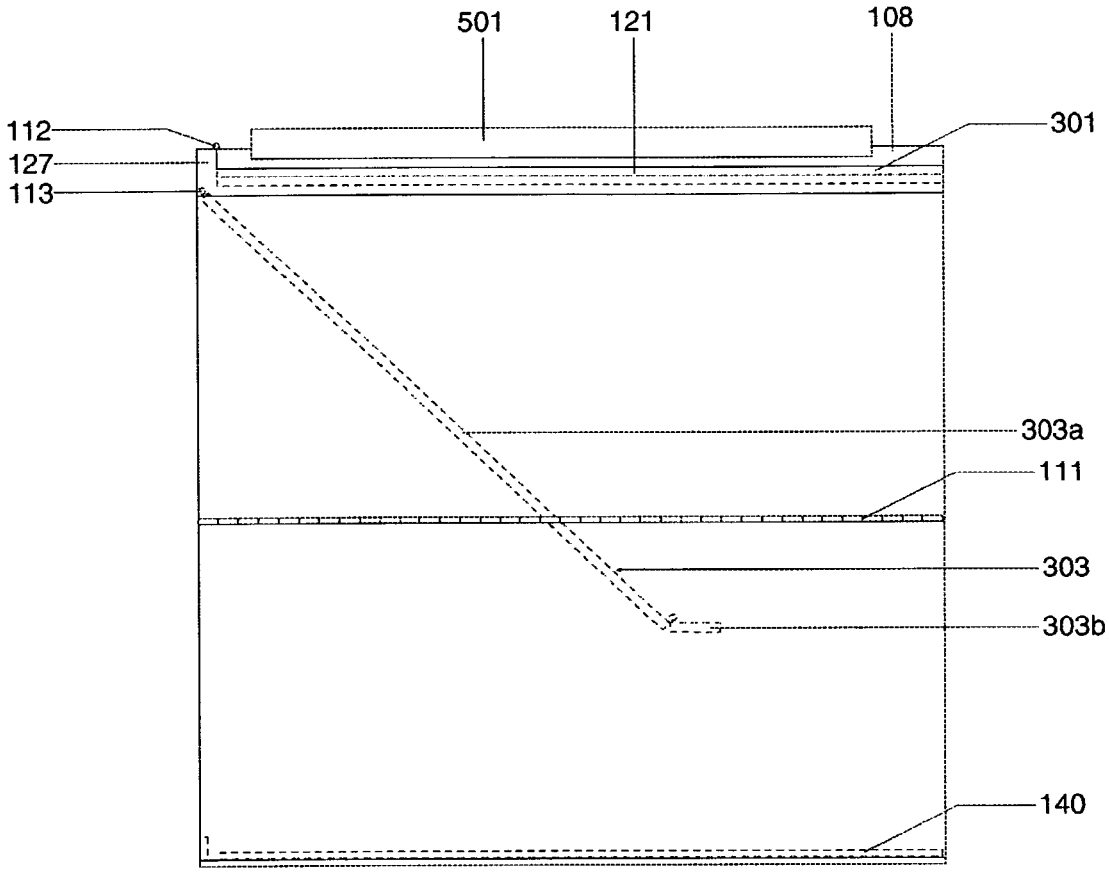
Figure 8C:
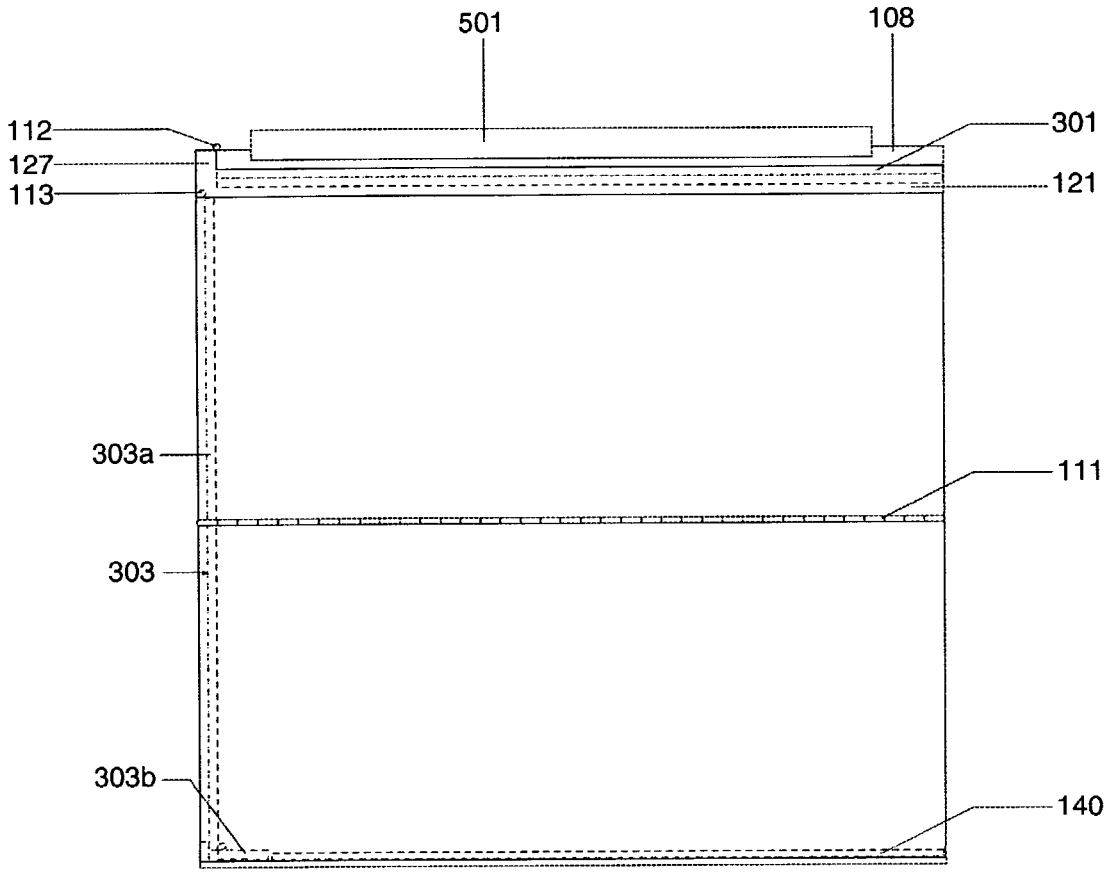

The outside surface of the bottom of panel 303, rests against abutment 295 (FIG. 10A), said abutment providing a means by which said panel is prevented from rotating more than 90 degrees. When back wall panel 303 is in the position shown in FIG. 4, said back wall panel prevents outer sidewall panels 104 and 105 from folding inward. FIGS. 8A, 8B and 8C show successive side views of panel 303 as said panel rotates downward upon hinge 113.

Figure 4A:
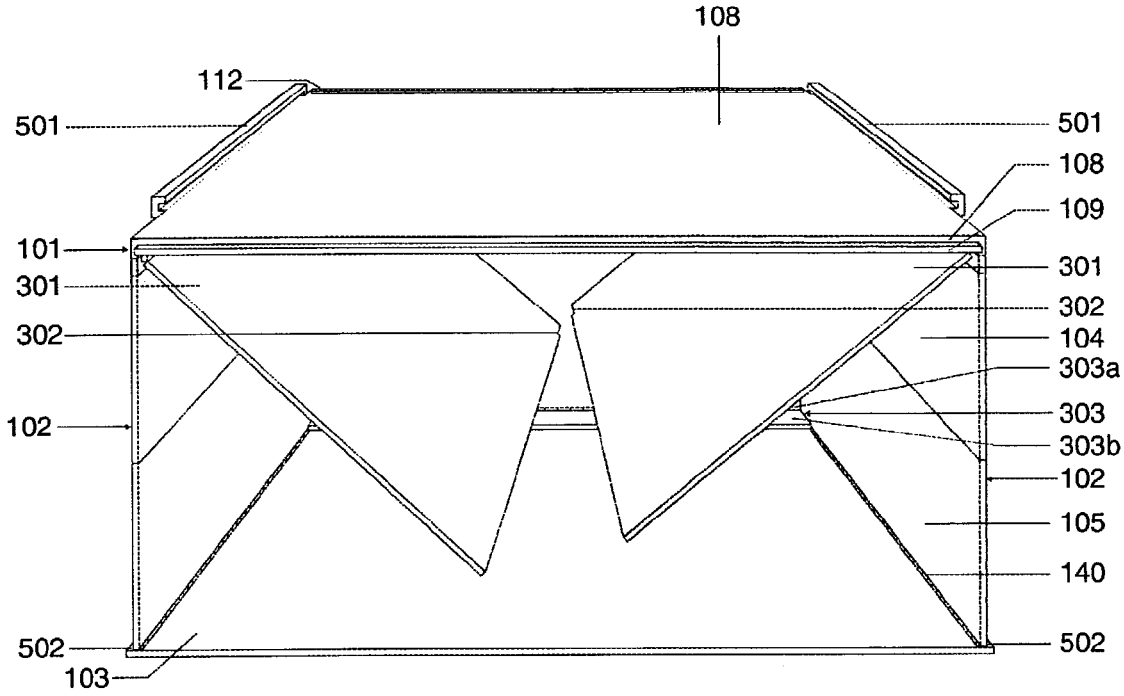
Figure 4B:
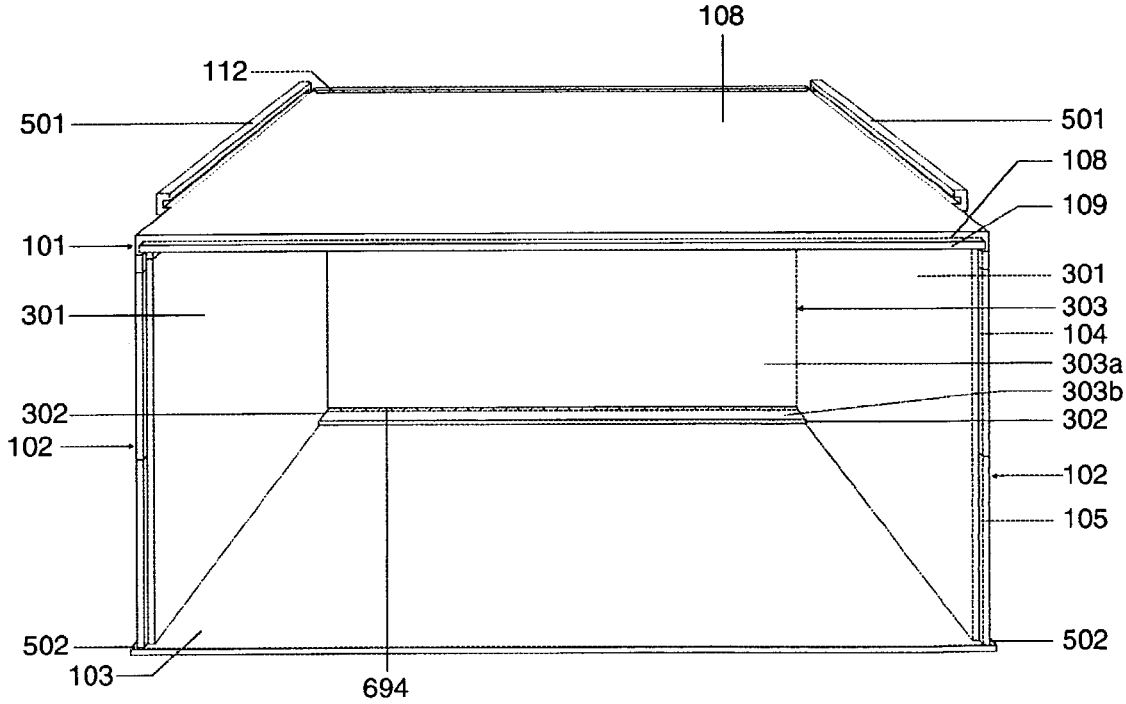

After panel 303 has rotated fully downward to form the back wall of the box, panels 301 (FIGS. 4A and 4B) will rotate downward to form the inner sidewalls of said box. FIG. 4A shows inner sidewall panel 301 rotated about one-half way downward. FIG. 4B shows panel 301 rotated fully downward, thereby forming the inners sidewalls of the box. Each of said panels 301 rotates upon a hinge (not shown) by which it is attached to the top of a respective outer sidewall panel 102.

When in the position shown in FIG. 4B, each of inner sidewall panels 301 primarily comprises a single solid surface that provides additional strength for bearing a load and prevents outer sidewall panels 104 and 105 from folding inward. Such additional strength is particularly important when a lower box is bearing a load on its top lid (108) while its front door panel (109) is in open position, as shown in FIG. 12E. In that circumstance, said lower box is absent a supporting vertical wall in the area provided for said front door and accordingly, said lower box may require the additional strength provided by inner sidewalls (301). Each of inner sidewall panels 301 stands adjacent to, and on the interior side of, a respective outer sidewall 102.

As shown in FIG. 3A, back wall panel 303 is comprised of upper segment 303*a* and lower segment 303*b*, said segments being attached to each other via a hinge. Upper segment 303*a* substantially extends from the top lid to the floor of said box. Lower segment 303*b* can be described as a "tail" or "extension," extending from the lower end of upper segment 303*a*. As back wall panel 303 rotates downward (as the box opens), lower segment 303*b* will hit floor 103 of the box. As said lower segment 303*b* hits said floor, said lower segment will turn about ninety degrees upon its hinge, thereby forming a right angle with upper segment 303*a* (as shown in FIG. 3B), while resting parallel to and atop said floor.

As shown in FIG. 4A, inner sidewall 301 has a small notch (302) cut out of its lower back corner. As inner sidewall 301 falls into the position shown in FIG. 4B, said notch 302 will come to rest over tail 303*b*. The bottom of notch 303 is cut just long enough to put pressure on tail 303*b*. Thereby, inner sidewall 301 effectively "locks" back wall panel 303 into position, preventing said panel from shifting from side to side. Such locking helps to stabilize the box, and keep it "in square" when said box is bearing a load on its top lid.

Figure 5:
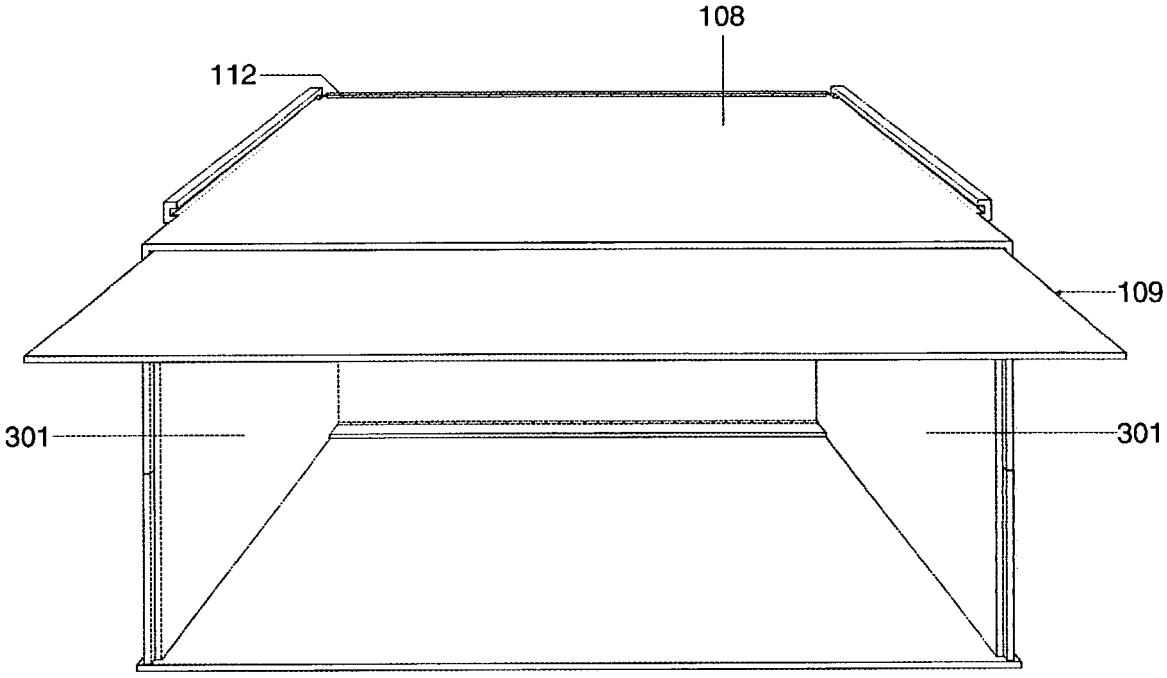
Figure 6:
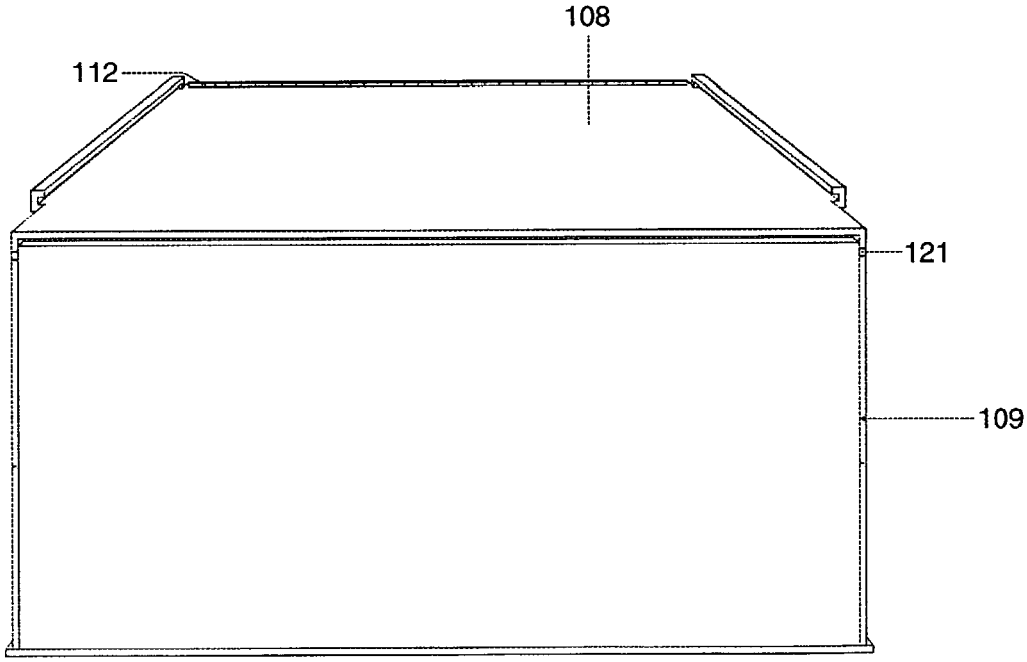

FIG. 5 shows panel 109 after said panel has been slid about halfway out from under top lid 108. FIG. 6 shows panel 109 after said panel has been slid all the way out from under top lid 108 and then turned downward ninety degrees, thereby forming the front door of the box of the present invention.

Figure 7A:
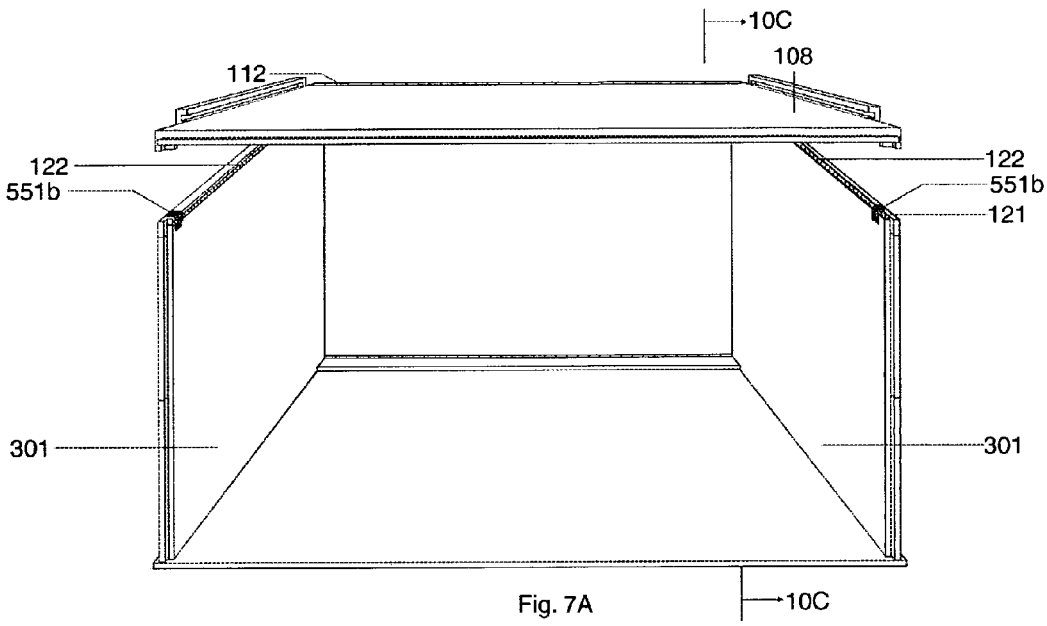
FIGS. 7A and 7B are perspective views showing the top lid in partially open and fully open positions, respectively.
Figure 7B:
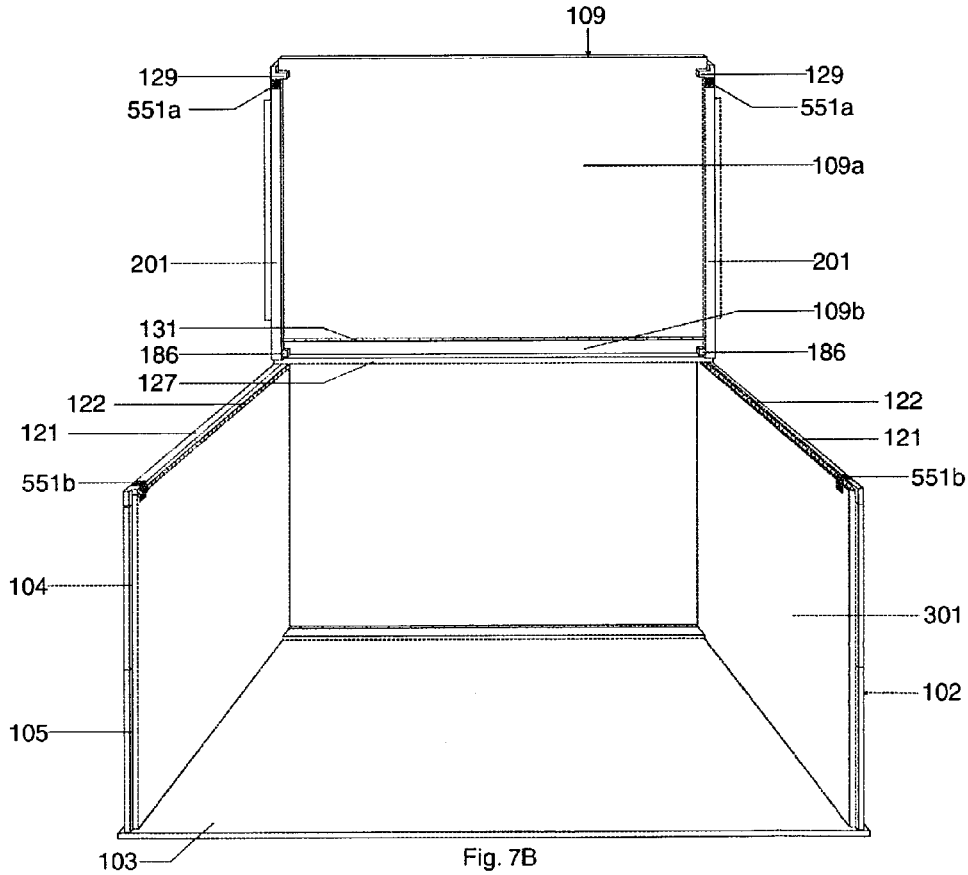

FIG. 7A shows top lid 108 slightly open. FIG. 7B shows top lid 108 open a full ninety degrees, said FIG. 7B showing the underside of said top lid. Top lid 108 rotates between open and closed positions upon hinge 112 (FIG. 7A). In the position shown in FIG. 7B, items can be placed inside or removed from said box through either its top side or front side (i.e., dual access), provided that said box is either standing alone or positioned at the top of a stack of boxes.

Figure 10A:
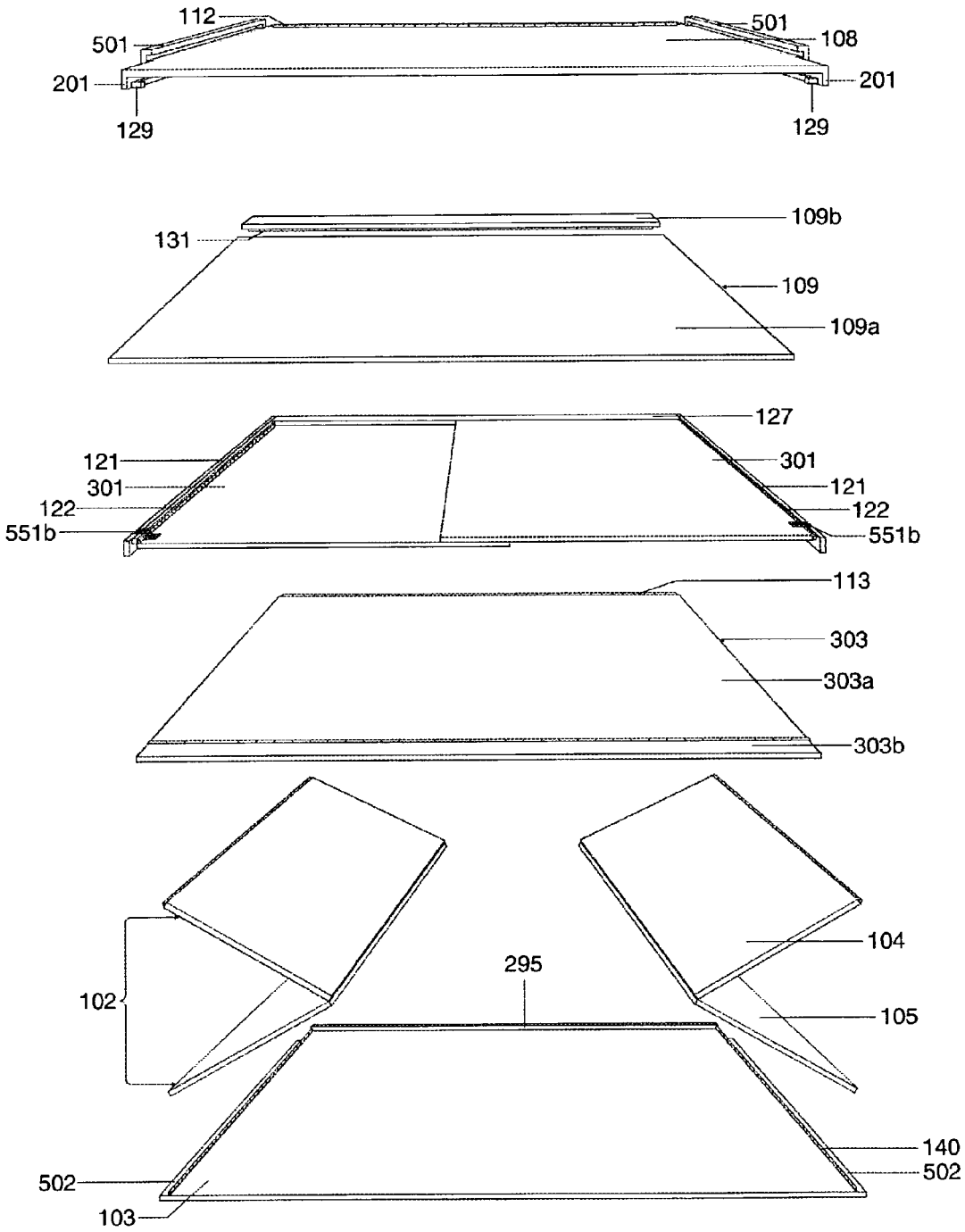
FIG. 10A is an exploded view of the various components that comprise said box.
Figure 10B:
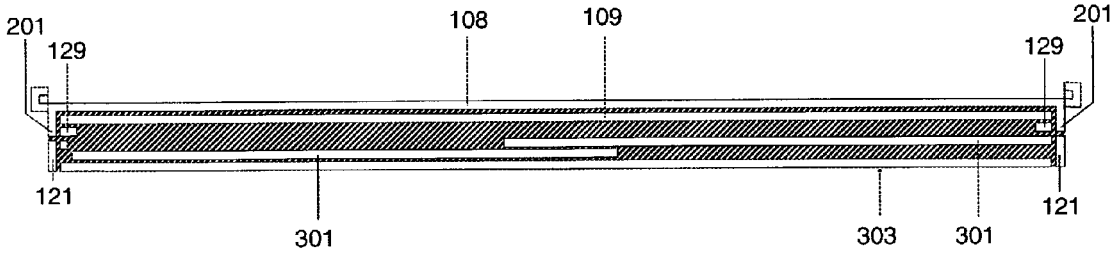
FIG. 10B is a frontal view of the upper section of said box when said upper section is in the position shown in FIG. 2. The elements that comprise said upper section have been separated from each other to assist clarity of explanation. The empty spaces created by said separations are indicated by diagonal hatch lines.
Figure 10C:
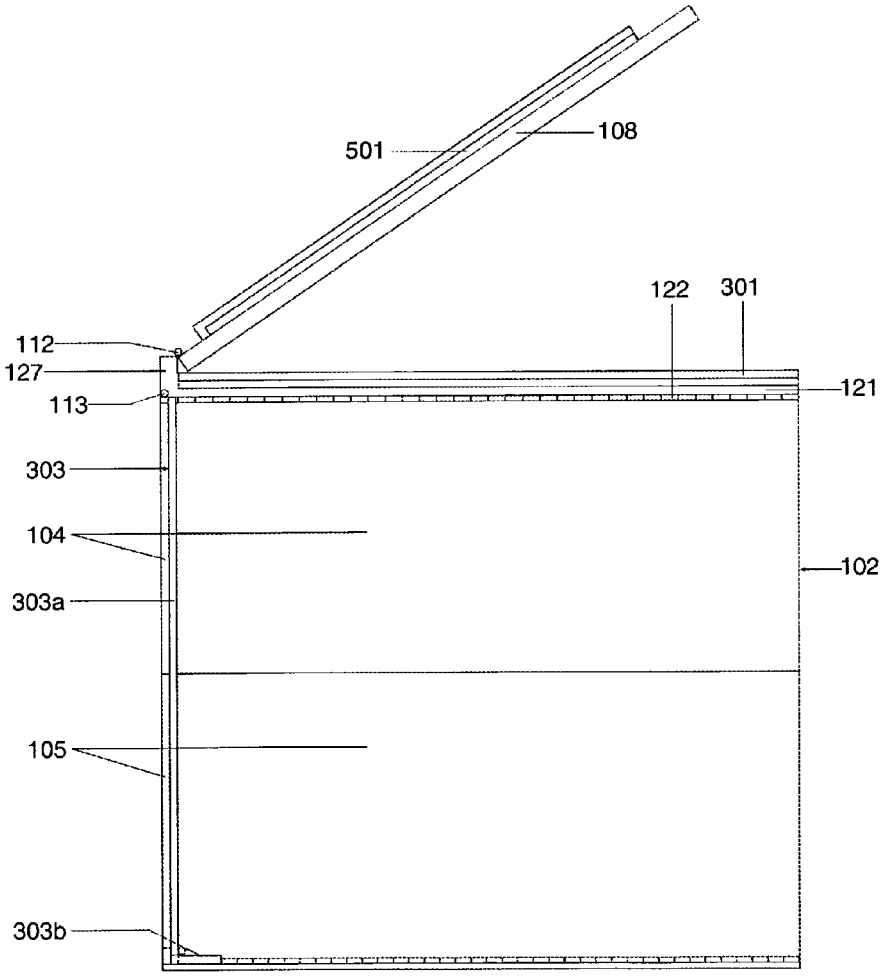
FIG. 10C is a sectional view taken along plane 10C in FIG. 7A. The plane along which said sectional view is taken is indicated by the upper and lower segments of a vertical line, respectively shown at the top and bottom of the drawing in FIG. 7A. The direction in which said sectional view is taken is indicated by horizontal arrows pointing right, said arrows extending from said vertical line.

FIG. 10C (which is a sectional view of FIG. 7A) shows member 121, said member attached to the top of outer sidewall panel 104 via hinge 122. When said box is in the process of being collapsed, and thereby moving successively through the positions shown in FIGS. 4B, 4A, 3B, 3A, 2 and 1, said outer sidewall panel 104 and said member 121 rotate upon hinge 122.

As shown in FIGS. 10A and 7B, back brace 127 is part of upper section 101 (FIGS. 1 and 2) and runs across the back of the box. Said back brace 127 connects the two members 121 which are positioned on opposed sides of said box. As shown in FIG. 10C, top lid 108 is attached to back brace 127 via hinge 112 and back wall panel 303 is attached to back brace 127 via hinge 113. As further shown in FIG. 10C, outer sidewall 102 is connected to member 121 via hinge 122. As shown in FIG. 7B, back brace 127 is connected to member 121.

In one preferred embodiment, top lid 108 is not directly connected to member 121, but rather only to back brace 127 via hinge 112. Such configuration allows top lid 108 to be opened, as shown in FIG. 10C. In another preferred embodiment, top lid 108 could be directly and permanently connected to member 121 along the entire length of said member. In that case, top lid 108 would not open and the only access to the box would be through its front. Such an alternative embodiment would have application in situations where only front access is required.

In the first preferred embodiment, and as shown in FIG. 7B, there is no front brace that connects the front ends of opposed members 121 in the manner that back brace 127 connects the back ends of said opposed members 121. Such configuration allows easy access to the interior of the box, as there is no frontal obstruction between the sidewalls. In an alternative embodiment, a front brace could connect the front ends of opposed members 121. In such alternative embodiment, there would be a frontal obstruction between sidewalls; said obstruction would add strength or stability to the structure of the box, but might make making loading and unloading more difficult.

Hook and loop configuration 551*a* (FIG. 7B) and 551*b* (FIGS. 7A and 7B), comprise a means by which top lid 108 (FIG. 7A ) can be secured to the tops of the vertical sidewalls (102 and 301) of said box, thereby holding said top lid in a closed position. Hook and loop, sold under the commonly known brand name VELCRO™ (as well as under other brand names) comprises two pieces of fabric, one of which comprises a series of hooks on one side, and the other of which comprises a series of loops on one side. When said hook fabric is pressed against said loop fabric, said two pieces of fabric grip each other and hold together. After gripping each other, said two pieces of fabric can be separated by pulling them apart. Such gripping and separating process can be repeated many times.

Hook fabric 551*a* is permanently attached to the bottom side of tracks 201 and loop fabric 551*b* is permanently attached to the top surfaces of vertical sidewalls 102 and 301. When top lid 108 is in a closed position (as shown in FIG. 3B), hook fabric 551*a* and loop fabric 551*b* press against and grip each other, thereby holding said top lid in a closed position. Subsequently, said top lid can be opened by manually gripping its front surface and pulling upward, thereby separating said hook and loop fabric. In the alternative, hook fabric 551*a* could be attached to the side walls and loop fabric 551*b* could be to the bottom side of the side walls, said hook and said loop being complementary to each other.

One benefit of the hook and loop configuration is that it provides a virtually effortless means of holding the box closed without the need to manipulate any type of fastener. However, the main benefit is that said configuration prevents the sidewalls of the box from flaring out (to an angle of greater than ninety degrees with respect to the floor of the box), when said box is in the process of being opened.

Said loop fabric 551*b* extends about an inch down the side of interior sidewall 301. When said box is in closed position, said extension of loop fabric will press against and grip hook fabric 551*a*, said hook fabric attached to the bottom side of top lid 108. As said box moves from closed to open position, said hook and loop fabrics will stay in contact with each other, said points of contact moving from the interior side of sidewalls 301 to the top surfaces of vertical sidewalls 102 and 301. Accordingly, said hook and loop fabrics will continuously grip each other as said box opens. Such gripping effectively binds the sidewalls to the top lid, thereby preventing said side walls from flaring out as said box opens.

Figure 11A:
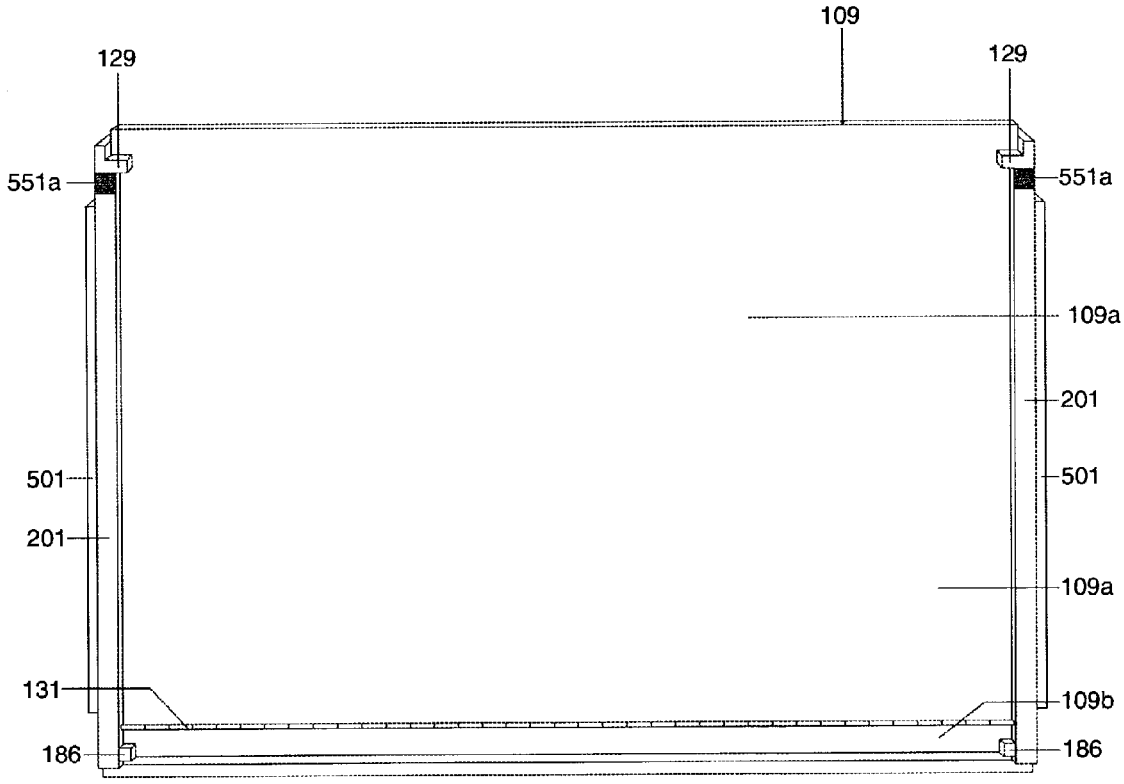
FIGS. 11A shows an enlarged view of the upper section of said box, said enlarged view illustrated from the same perspective as FIG. 7B. Said view shows the underside of the middle panel that can be pulled into position to form the front door of said box.
Figure 11B:
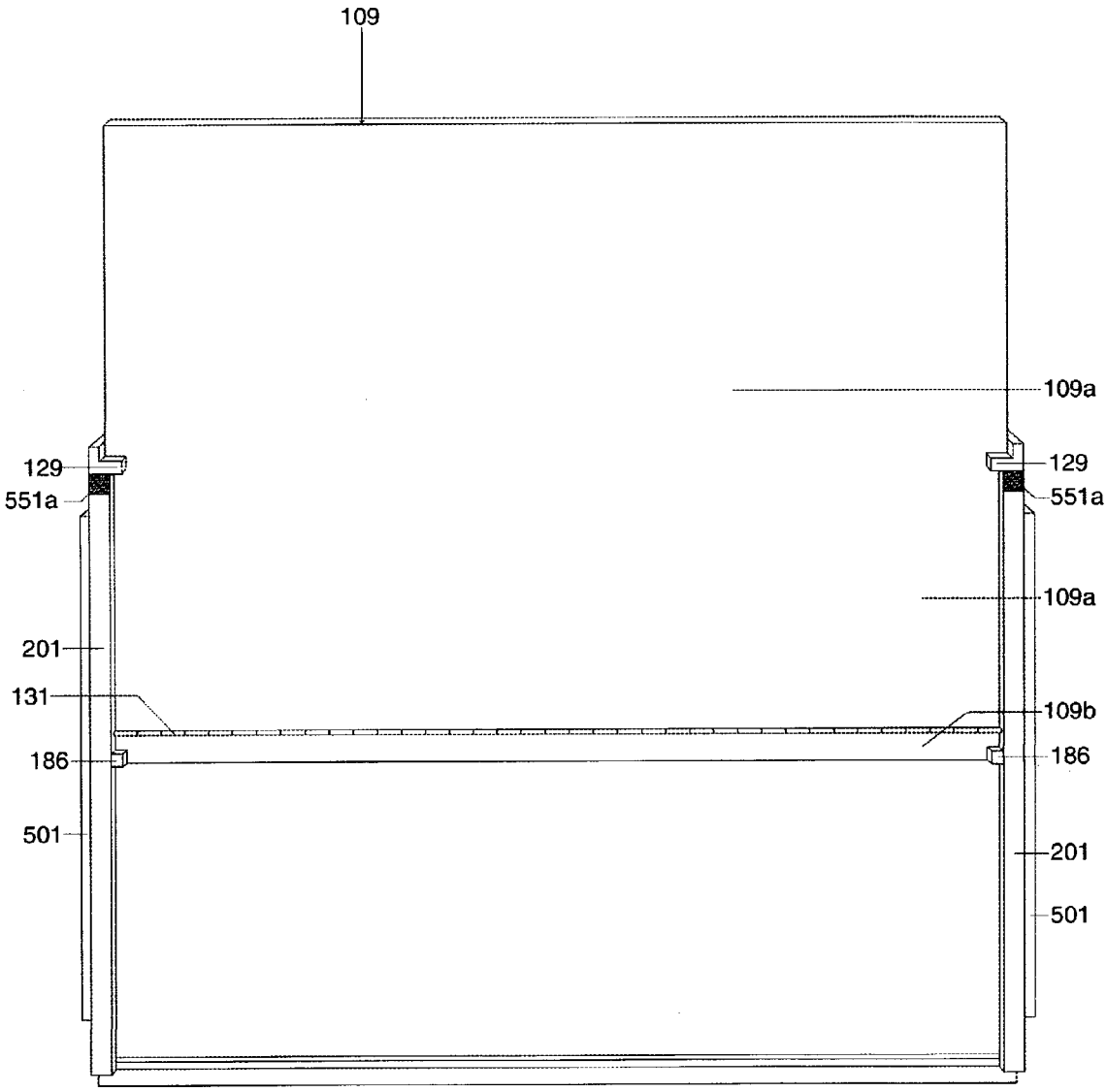
FIG. 11B shows said middle panel after it has been pulled about one-half way out of said upper section.

FIGS. 7B, 11A and 11B show the means by which panel 109 can be slid out from under top lid 108 and then turned downward ninety degrees to form the front door of the box of the present invention. Panel 109 slides on tracks 201. In a preferred embodiment, tracks 201 essentially comprise a pair of channels that extend from the distal ends of top lid 108. Each channel within said set comprises a first member that extends perpendicularly from the bottom side of said top lid and a second member that turns inward and extends perpendicularly from said first member. Said second member of each channel lies directly beneath panel 109.

FIG. 11A shows panel 109 prior to being slid forward and when in the position shown in FIG. 4B. FIG. 11B shows said panel after it has been slid forward about halfway and into the position shown in FIG. 5. Said tracks comprise a means by which said panel can slide. In one alternative embodiment, the panel which comprises the front door of the box could be configured to lie above top lid 108, rather than below said top lid. There are many alternative embodiments by which the tracks upon which said channels slide could be configured.

As shown in FIGS. 7B, 11A and 11B: (i) the top ends of tracks 201 comprise stopper blocks 129. Member 126 is attached to the bottom end of panel 109 via hinge 131. and (ii) the bottom ends of panel 109 comprise stopper blocks 186. The position of each of said stopper blocks 129 is fixed, whereas each of said stopper blocks 186 moves along with panel 109. As panel 109 slides forward, stopper blocks 186 will come to abut stopper blocks 129, thereby preventing said panel from sliding further and becoming detached from the box of the present invention. Upon abutment, panel 109 can be turned downward ninety degrees upon hinge 131, thereby forming the front door of the box of the present invention. Said panel 109 comprises (i) main body 109*a* and (ii) bottom end 109*b*, said elements attached to each other via hinge 131.

Stopper blocks 129 and 186 comprise a means of limiting the extent to which panel 109 can slide forward. Alternative embodiments might use means other than stopper blocks to limit the extent to which panel 109 can slide forward. For example, a set of chains could be attached to the back end of said panel, said chains anchored on their other end to a surface on said box.

Figure 12A:
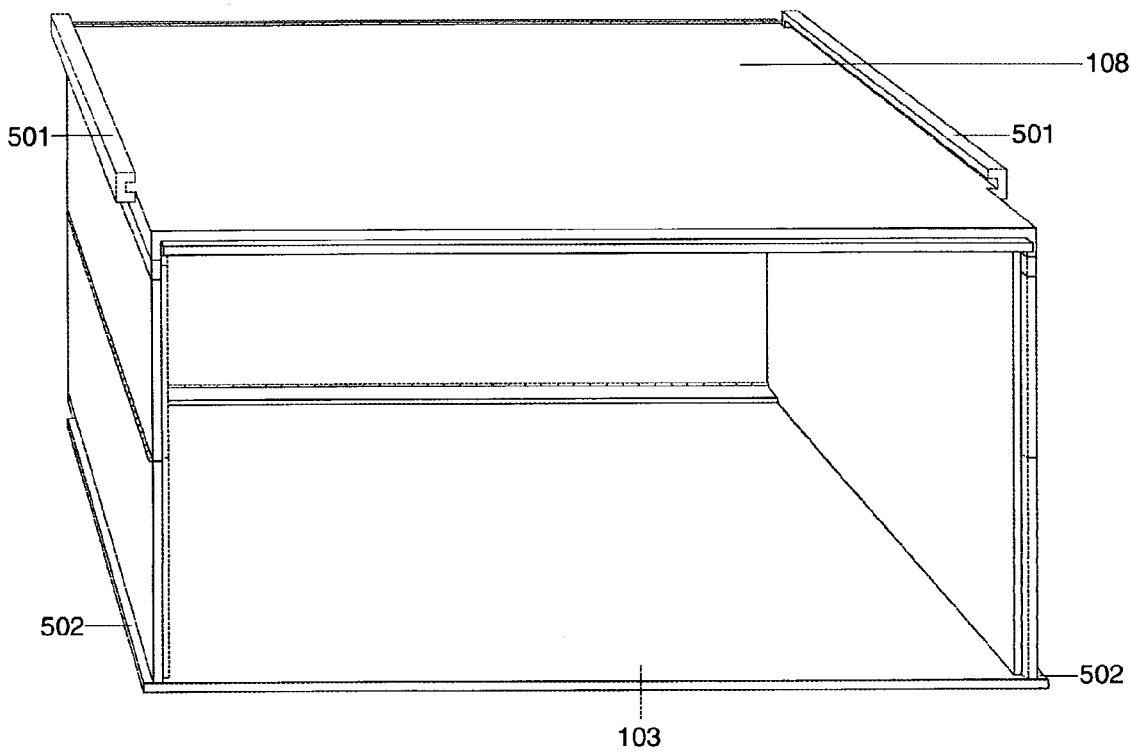
FIGS. 12A thru 12F show perspective views of the track and runner structures at the top and bottom of said box, respectively. Said structures comprise a means of connecting and joining a plurality of boxes of the present invention, when said boxes are vertically stacked. Boxes that are so connected will all open simultaneously when the upper section of the top box is lifted upwardly.
Figure 12B:
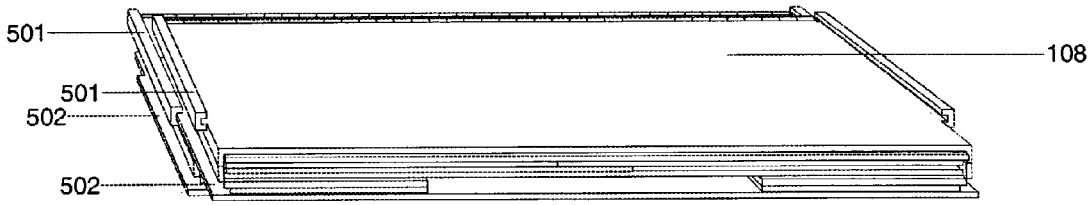
Figure 12C:
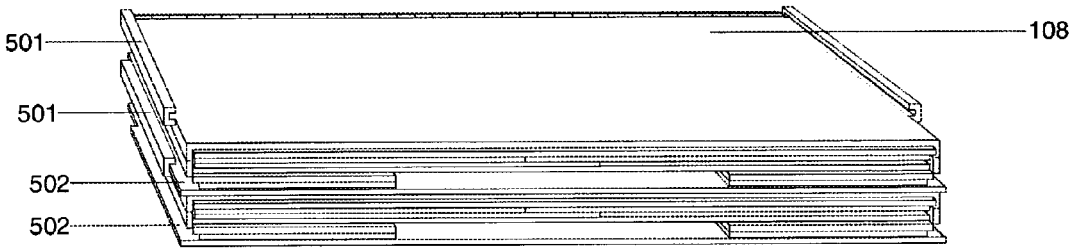
Figure 12D:
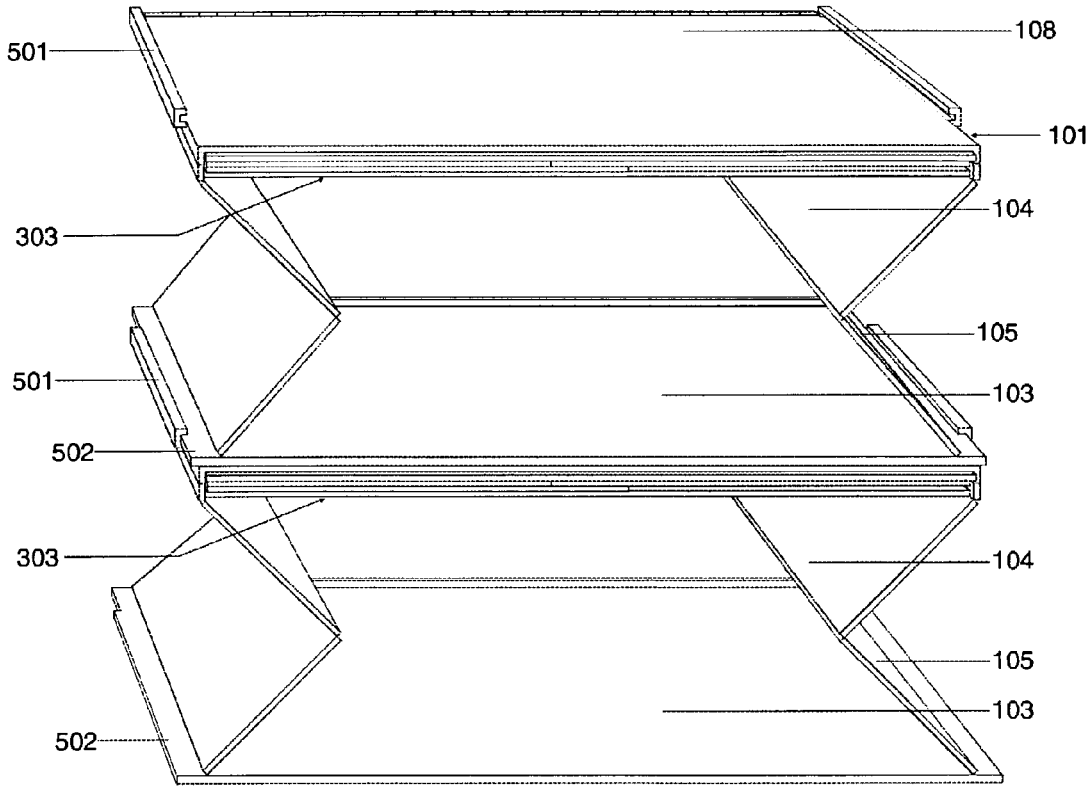
Figure 12E:
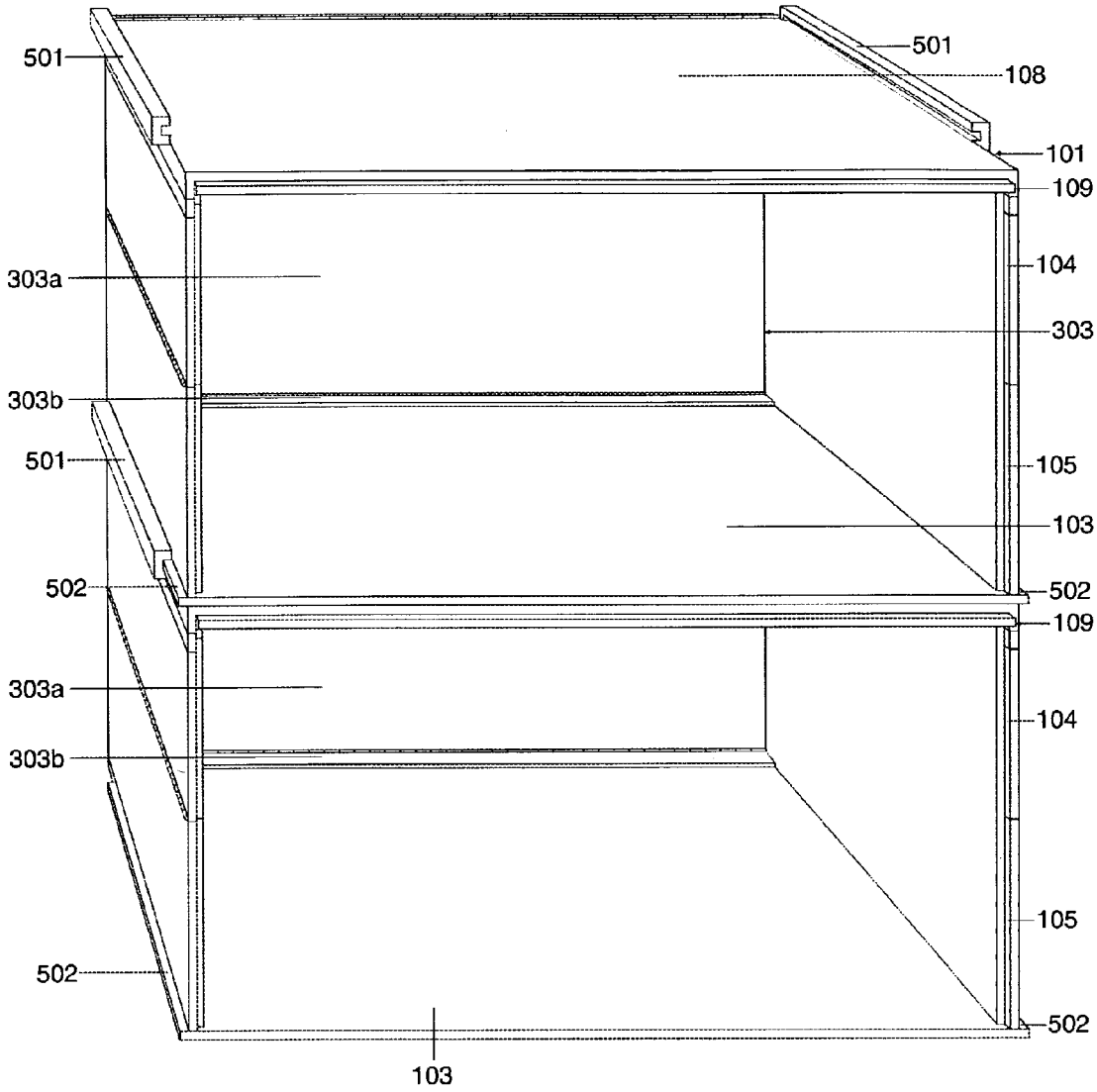
Figure 12F:
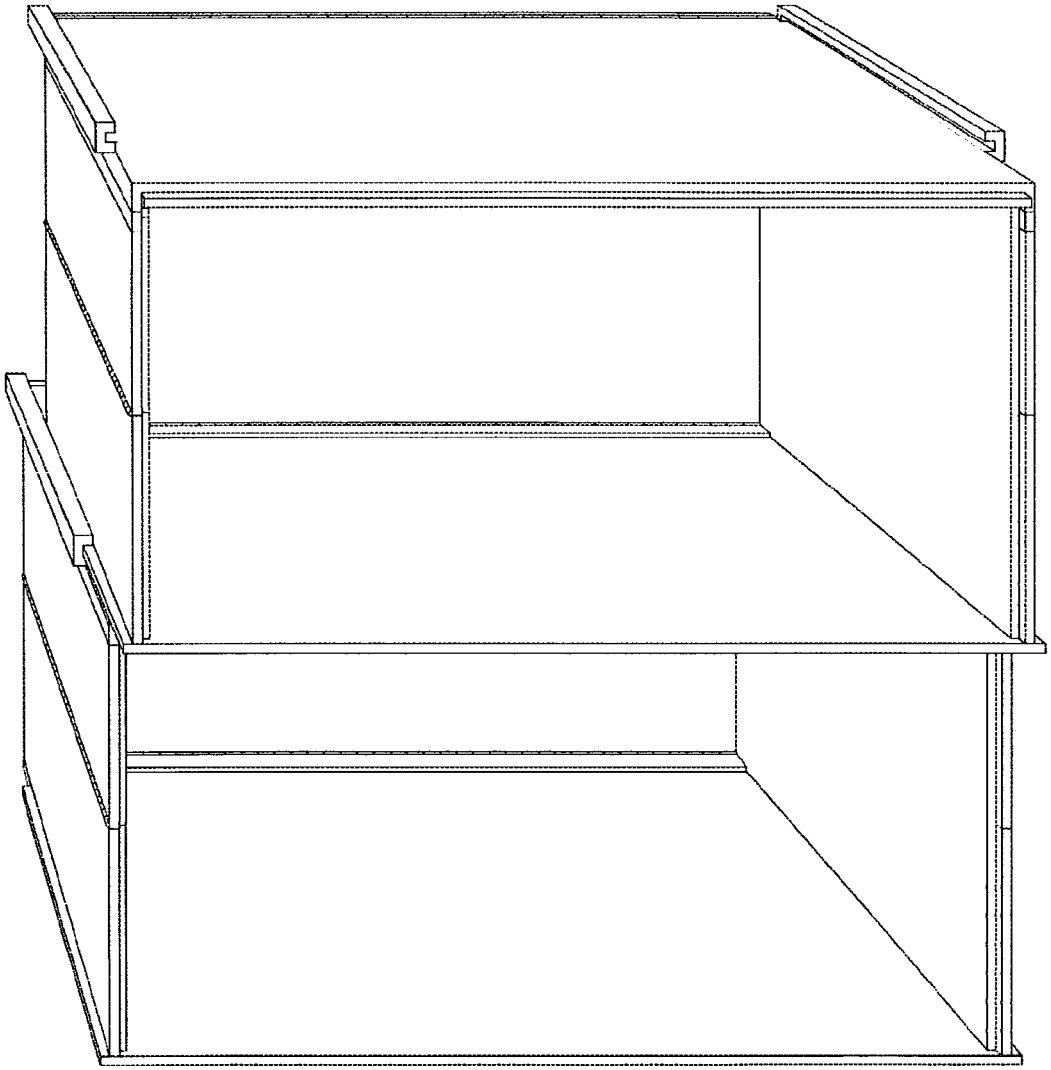

FIGS. 12A thru 12F show the track and runner structures that comprise a means of connecting and joining a plurality of boxes of the present invention, when said boxes are vertically stacked. FIG. 12A shows tracks 501 at the top of the box of the present invention and runners 502 at the bottom of said box. In a preferred embodiment, tracks 501 essentially comprise a pair of horizontal channels that extend from distal ends of top lid 108. Each channel within said pair comprises a first member that extends horizontally and continuously from said distal ends, a second member that extends perpendicularly from said first member and a third member that turns inward and extends perpendicularly from said second member. Runners 502 essentially comprise a set of horizontal members that continuously extend from distal ends of floor 103. When boxes are vertically stacked, runners 502 of an upper box can be slid horizontally into tracks 501 of a lower box.

Each of FIGS. 12B and 12C shows two units of the box of the present invention, said boxes vertically stacked, each of said boxes in fully collapsed position. FIG. 12B shows runners 502 of the upper box slid about two-thirds of the way into tracks 501 of the lower box. FIG. 12C shows runners 502 of the upper box slid all of the way into tracks 501 of the lower box.

FIGS. 12D and 12E respectively show said vertically stacked boxes partially and fully open after upper section 101 of the top box has been gripped by hand and lifted upward. As said upper section is lifted it will separate from lower section 103 of both the upper box and lower box and both boxes will open simultaneously. As said upper and lower sections separate, outer sidewall panels 104 and 105 and back wall panels 303 of both boxes will rotate into open position. Accordingly, all boxes in a vertical stack can be opened simultaneously by lifting upper section 101 of the top box.

Runners 502 and tracks 501 comprise a means of connecting and joining the bottom of one box to the top of another box when said boxes are vertically stacked, said means preventing said boxes from separating from each other when a box in said stack is lifted upwardly. Alternative embodiments could provide other means of preventing vertically stacked boxes from so separating.

Figure 13:
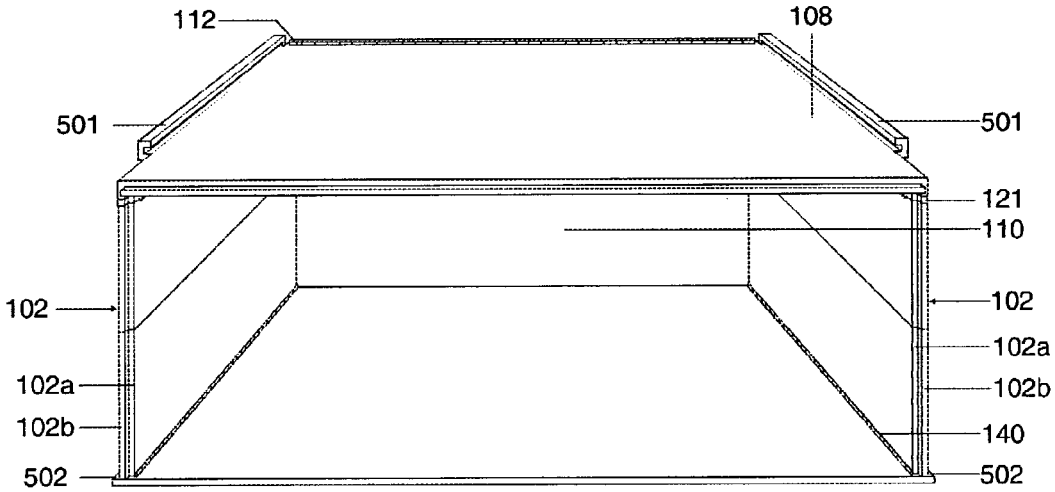
FIG. 13 shows an alternative embodiment of the box of the present invention which there are no inner sidewalls.

FIG. 13 shows another preferred embodiment of the box of the present invention in which inner sidewall panels 301 are absent. Such alternative embodiment of said box may have less load bearing strength than other embodiments, as well as less security against outer sidewall panels 104 and 105 folding inward and collapsing. Accordingly, this embodiment might be used where the box is not required to support a load on its top lid, or is only required to support a relatively light load.

Figure 14:
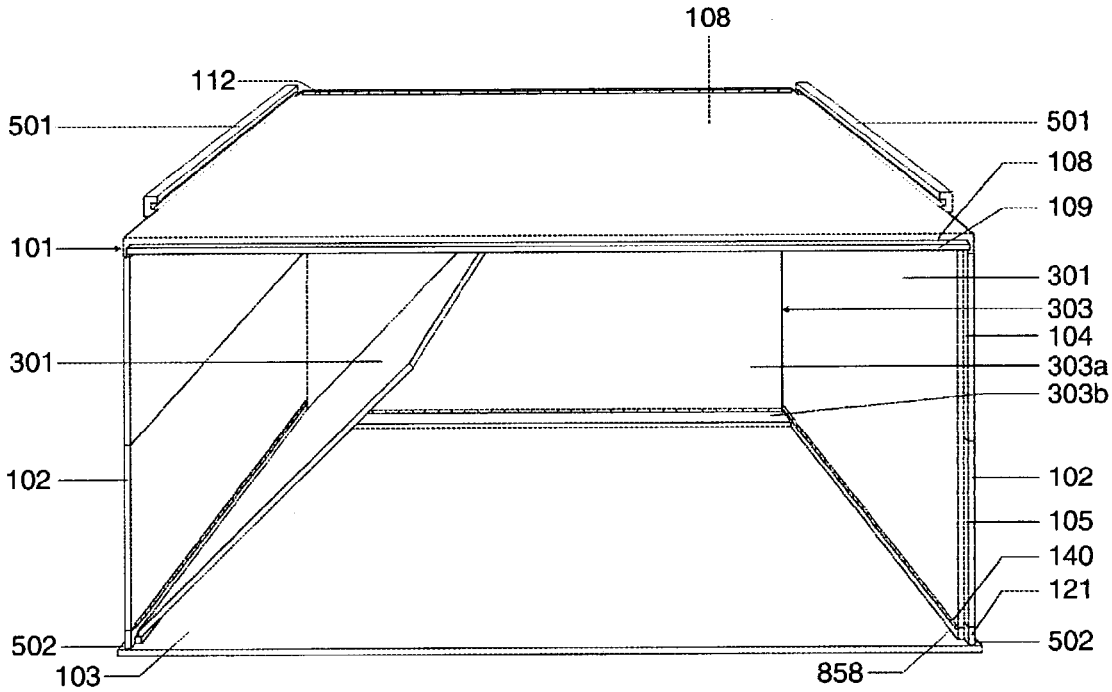
FIG. 14 shows an alternative embodiment in which the inner sidewalls are hinged to the bottom of the outer sidewalls, rather than to the top of said outer sidewalls as is the case for the preferred embodiment of the present invention.

FIG. 14 shows another embodiment in which inner sidewalls 301 are attached to the bottom of outer sidewalls 102 via hinge 858. FIG. 14 shows left sidewall 301 about one-half way open and right sidewall 301 fully open. When said box is in closed position, both of said sidewalls 301 rest horizontally above floor 103. After outer sidewalls 102 box have been opened, said inner sidewalls 301 must be manually lifted upward until said inner sidewalls are flush up against said outer sidewalls.

Figure 9:
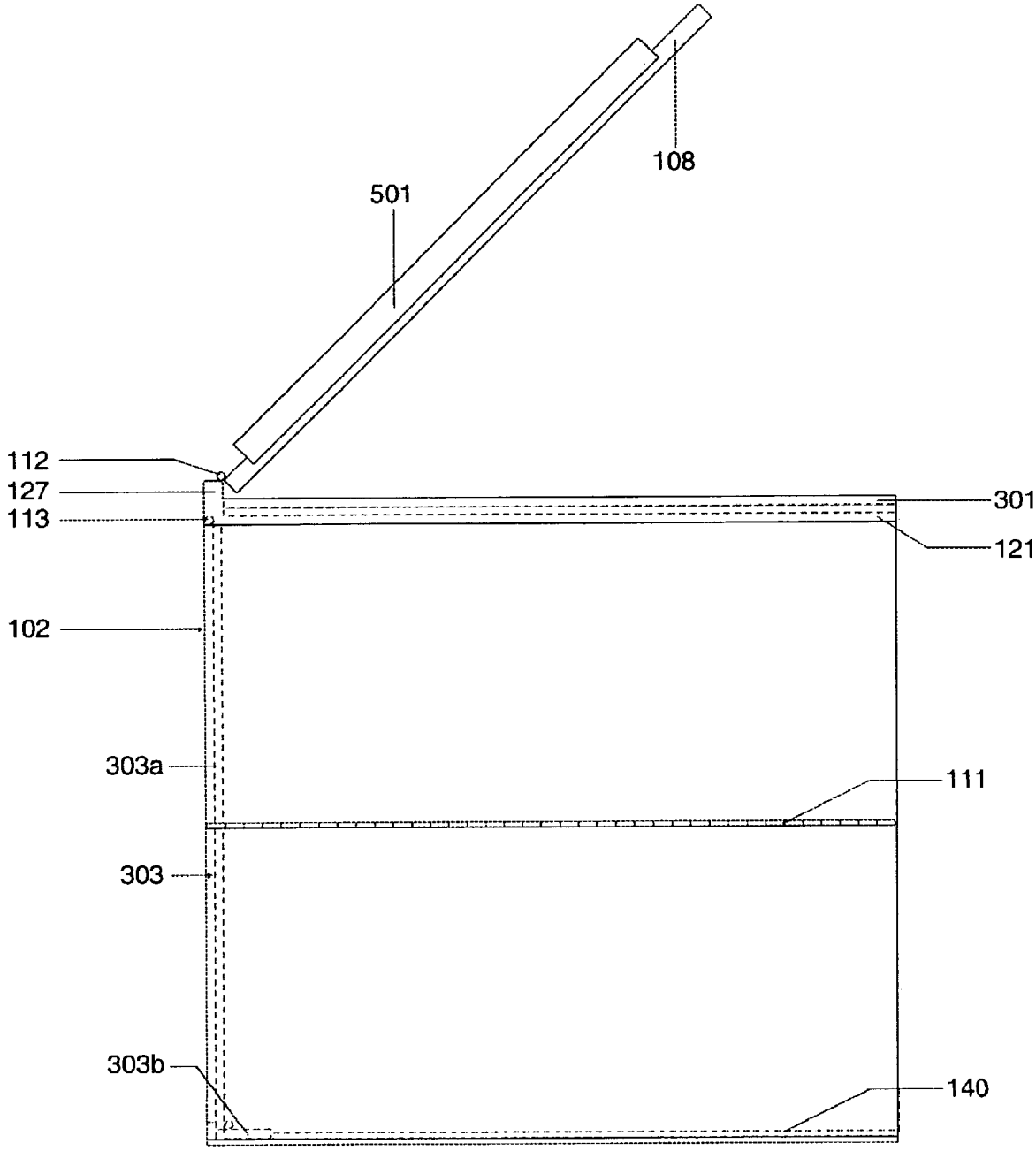
FIG. 9 is a side view showing the top lid in partially open position.
Figure 15:
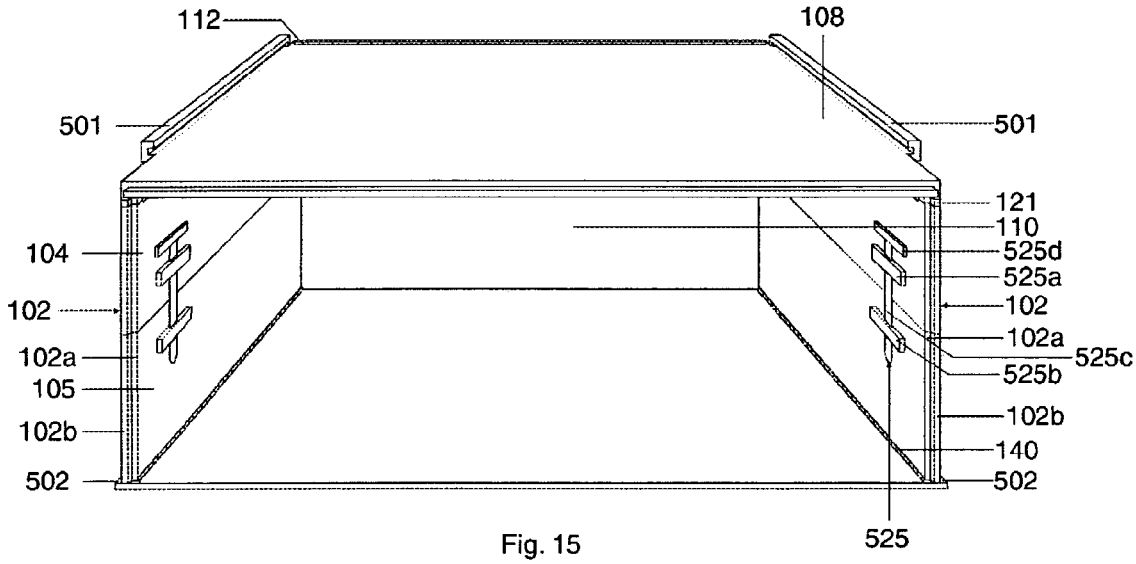

FIG. 15 shows still another preferred embodiment in which locking mechanism 525 is attached to outer sidewall panels 104 and 105. Said locking mechanism prevents said outer sidewall panels from folding inward and collapsing and is an alternative to interior sidewalls 301, which are absent in FIG. 15. Said locking mechanism comprises enclosures 525*a* and 525*b* which are attached to panels 104 and 105, respectively. Shaft 525*c* can slide in and out through said enclosures. When slid-in (as shown in FIG. 15), said shaft crosses over hinge 111 (FIG. 9) and thereby "locks-in" panels 104 and 105, preventing said panels from folding inward and collapsing. Head 525*d* prevents shaft 525*c* from slipping all the way through enclosures 525*a* and 525*b*.

Wherever the word "hinge" is used herein, such hinge comprises a means by which one or more of the surfaces to which said hinge is attached can pivot about a horizontal axis. Such hinge can be made of a variety of materials including, without limitation, metal, plastic or paper and can comprise a variety of different structures. In particular, such hinge may comprise a length of flat, flexible tape that is affixed to a surface by glue or other means. In the alternative, such hinge may created within a wall by simple scoring, or cutting partially through, said wall; such embodiment sometimes referred to as a "living hinge."

While the above description contains many specificities, these should not be construed as limitations on the scope of the invention, but rather as exemplifications of one or more embodiments thereof. Other variations and embodiments are possible. Those who are skilled in the art will readily perceive how to modify the invention. Therefore, the appended claims are to be construed to cover all equivalent structures which fall within the true scope and spirit of the invention and should not be limited to the embodiments illustrated.

We claim:

1. A collapsible box providing both top access and front access to the interior of said box comprising:

a set of interconnected walls that assemble to form a top lid openable to allow top access to the interior of said box;

a floor;

a pair of opposed vertical sidewalls each comprising a set of upper and lower panels, said upper and lower panels attached to each other via a horizontally extending hinge about which said panels pivot and fold-when said box is collapsed;

a backwall, said top lid being hingedly attached to a top of said backwall; an open space at a front side of said box opposite said backwall allowing frontal access to the interior of said box; and a front door configured and adapted to cover said open space at said front side of said box when in a closed position and to allow access through said front of said box when in an open position, wherein said box is substantially flat when in a collapsed configuration and substantially rectangular when in a set-up configuration and said top lid further comprises opposed guide channels, wherein said front door is slidable within said guide channels and foldable downward from said top lid to close said open space.

2. The box of claim 1, further comprising means for connecting the bottom of one box to the top of another box when said boxes are placed in a vertical stack, said means preventing said boxes from separating from each other when a box in said stack is lifted upwardly.

3. The box of claim 1, further comprising a first length of hook and loop fabric attached to its lid and a second complementary length of hook and loop fabric attached to its sidewalls for releasably securing said lid to said sidewalls.

4. The box of claim 1, wherein said box is formed of plastic, metal, cardboard, or wood.

5. A box according to claim 1, further comprising first stopper blocks disposed in said guide channels and second stopper blocks disposed on said front door and engageable with said first stopper blocks to retain said front door with said top lid.

6. A box according to claim 1, further comprising a hinge formed in said front door, wherein when said second stopper blocks engage said first stopper blocks, said front door turns downward about said hinge to close said open space.

7. A collapsible box comprising:

a set of interconnected walls that assemble to form a top lid;

a floor;

a pair of opposed vertical outer sidewalls each comprising a set of upper and lower panels, said upper and lower panels attached to each other via a hinge upon which said panels pivot and fold about a horizontal axis when said box is collapsed;

a pair of opposed vertical inner sidewalls;

a backwall; and an open space at a front side of said box opposite said backwall allowing frontal access to an interior space within said box wherein said box is substantially flat when in a collapsed configuration and substantially rectangular when in a set-up configuration.

8. The box of claim 7, further comprising means for connecting the bottom of one box to the top of another box when said boxes are placed in a vertical stack, said means preventing said boxes from separating from each other when a box in said stack is lifted upwardly.

9. The box of claim 7, further comprising a first length of hook and loop fabric attached to its lid and a second complementary length of hook and loop fabric attached to its outer sidewalls for releasably securing said lid to said outer sidewalls.

10. The box of claim 7, further comprising a front door configured and adapted to cover said open space at said front side of said box when in a closed position and allow access to said front side of said box when in an open position.

11. The box of claim 7, wherein said box is formed of plastic, metal, cardboard, or wood.

12. A collapsible box providing both top access and front access to the interior of said box comprising:

a set of interconnected walls that assemble to form a top lid openable to allow top access to the interior of said box;

a floor;

a pair of opposed vertical outer sidewalls each comprising a set of upper and lower panels, said upper and lower panels attached to each other via a horizontally extending hinge about which said panels pivot and foldwhen said box is collapsed;

a backwall, said top lid being hingedly attached to a top of said backwall; and an open space at a front side of said box opposite said backwall allowing frontal access to the interior of said box, wherein said box is substantially flat when in a collapsed configuration and substantially rectangular when in a set-up configuration and further comprising a pair of opposed vertical inner sidewalls.

13. The box of claim 12, further comprising means for connecting the bottom of one box to the top of another box when said boxes are placed in a vertical stack, said means preventing said boxes from separating from each other when a box in said stack is lifted upwardly.

14. The box of claim 12, further comprising a first length of hook and loop fabric attached to its lid and a second complementary length of hook and loop fabric attached to its outer sidewalls for releasably securing said lid to said outer sidewalls.

15. The box of claim 12, further comprising a front door configured and adapted to cover said open space at said front side of said box when in a closed position and allow access to said front side of said box when in an open position.

16. The box of claim 12, wherein said box is formed of plastic, metal, cardboard, or wood.

* * * * *